US008727255B2

(12) United States Patent
Kim

(10) Patent No.: US 8,727,255 B2
(45) Date of Patent: May 20, 2014

(54) AUTOMATIC PAPER FEED-SENSING APPARATUS FOR A PAPER SHREDDER, PAPER-FEEDING APPARATUS COMPRISING SAME, AND PAPER SHREDDER COMPRISING THE AUTOMATIC PAPER FEED-SENSING APPARATUS AND THE PAPER-FEEDING APPARATUS

(75) Inventor: Hak Hyun Kim, Pohang-si (KR)

(73) Assignee: Royal Sovereign International, Inc., Rockleigh, NJ (US)

( * ) Notice: Subject to any disclaimer, the term of this patent is extended or adjusted under 35 U.S.C. 154(b) by 314 days.

(21) Appl. No.: 13/202,777

(22) PCT Filed: Feb. 25, 2010

(86) PCT No.: PCT/KR2010/001185

§ 371 (c)(1),
(2), (4) Date: Aug. 23, 2011

(87) PCT Pub. No.: WO2010/098599

PCT Pub. Date: Sep. 2, 2010

(65) Prior Publication Data

US 2011/0303775 A1 Dec. 15, 2011

(30) Foreign Application Priority Data

Feb. 25, 2009 (CN) ..... 2009 2 0007121
Sep. 11, 2009 (KR) ..... 10-2009-0086138

(51) Int. Cl.
*B02C 18/22* (2006.01)

(52) U.S. Cl.
USPC ..... 241/225; 241/236; 241/100

(58) Field of Classification Search
USPC ..... 241/225, 222, 224, 100, 236, 245, 248
See application file for complete search history.

(56) References Cited

U.S. PATENT DOCUMENTS

| | | | | |
|---|---|---|---|---|
| 5,167,374 | A | 12/1992 | Strohmeyer | |
| 7,311,276 | B2 | 12/2007 | Matlin et al. | |
| 7,422,171 | B2 * | 9/2008 | Huang | 241/225 |
| 7,631,822 | B2 | 12/2009 | Matlin et al. | |
| 7,631,823 | B2 | 12/2009 | Matlin et al. | |

(Continued)

OTHER PUBLICATIONS

International Search Report—PCT/KR2010/001185 dated Dec. 9, 2010.

*Primary Examiner* — Faye Francis
(74) *Attorney, Agent, or Firm* — Cantor Colburn LLP

(57) ABSTRACT

Disclosed are an automatic paper feeding sensing device and a paper feeding device for a paper shredder, and a paper shredder including the automatic paper feeding sensing device and the paper feeding device. The automatic paper feeding sensing device of the present invention includes a detection sensor fixed to an end of a sensor bracket disposed at a side of a paper feeding entrance of a paper shredder; and a rotating lever rotatably disposed between the paper feeding entrance and the detection sensor to open or close a front side of the detection sensor by the rotation thereof. The paper feeding device of the present invention includes a paper feeding section, a paper feeding entrance, a paper feeding rollers and a pressurizing portion. The paper shredder includes the paper feeding device of claim 5 with the automatic paper feeding sensing device of claim 1, the paper shredder including a cutter portion which comprises a plurality of cutter blades to shred paper and a driving motor configured to drive the cutter portion.

22 Claims, 12 Drawing Sheets

(56) References Cited

U.S. PATENT DOCUMENTS

| | | | | |
|---|---|---|---|---|
| 7,631,824 | B2 | 12/2009 | Matlin et al. | |
| 7,635,102 | B2 | 12/2009 | Matlin et al. | |
| 7,661,614 | B2 | 2/2010 | Matlin | |
| 7,712,689 | B2 | 5/2010 | Matlin et al. | |
| 7,798,435 | B2 | 9/2010 | Matlin | |
| 8,061,635 | B2 * | 11/2011 | Kim et al. | 241/36 |
| 8,196,851 | B2 * | 6/2012 | Aries et al. | 241/225 |
| 8,403,246 | B2 * | 3/2013 | Seo et al. | 241/225 |
| 2002/0070300 | A1 * | 6/2002 | McLean et al. | 241/30 |
| 2010/0044484 | A1 * | 2/2010 | Chen | 241/101.5 |
| 2010/0320675 | A1 * | 12/2010 | Kim et al. | 271/109 |
| 2011/0068530 | A1 * | 3/2011 | Ahn et al. | 271/10.11 |
| 2012/0018554 | A1 * | 1/2012 | Seo et al. | 241/101.2 |

* cited by examiner

AUTOMATIC PAPER FEED-SENSING APPARATUS FOR A PAPER SHREDDER, PAPER-FEEDING APPARATUS COMPRISING SAME, AND PAPER SHREDDER COMPRISING THE AUTOMATIC PAPER FEED-SENSING APPARATUS AND THE PAPER-FEEDING APPARATUS

BACKGROUND OF THE INVENTION

1. Field of the Invention

The present invention relates to a paper shredder and component parts thereof, and more particularly, to an automatic paper feeding sensing device for a paper shredder in an optical detection or lever-type detection manner, a paper feeding device including the automatic paper feeding sensing device, and a paper shredder including the devices.

2. Description of the Related Art

Paper shredders are office machines which are used to shred confidential documents swiftly and safely. Such a paper shredder includes a paper feeding sensing device as a unit which automatically detects papers to operate a driving motor when papers to be shredded are put into the paper shredder. The paper feeding sensing device is configured to detect papers being fed and drive the driving motor. The driving motor operates a shredder cutter to shred the documents.

However, typical paper shredders adopt non-contact sensors. When such a non-contact sensor is used for an extended period of time, paper dust is likely to be heaped on the surface of the sensor, causing the sensor to malfunction even when there is no paper to be detected. In this case, the paper dust must be wiped off for the sensor and the shredder to work normally. However, it is almost impossible for an ordinary user to disassemble the paper shredder himself or herself and wipe off the dust on the surface of the sensor.

Also, when there is only one sheet of paper waiting to be shredded, the signal sent by the sensor easily penetrates the paper and causes the sensor to malfunction. It can be addressed by lowering the sensitivity of the sensor. Then, however, the failure rate of the paper shredder is prone to increase due to the malfunctioning caused by the paper dust.

A paper feeding device of a paper shredder including such a paper feeding sensing device is configured to feed papers to be shredded, sheet by sheet or sheets by sheets, into the paper shredder using the paper feeding rollers. A paper shredder including an automatic paper feeding device according to a related art has a paper feeding structure which is employed to different product lines such as printers and fax machines so as to continuously and automatically feed a certain amount of paper.

In the paper feeding method applied to the different product lines according to the related art, one end of the sheet of paper is controlled to continuously feed a certain amount of paper. When multiple sheets of paper are supplied simultaneously to the paper feeding tray or the paper tray, the topmost sheet of standby papers is transferred into a position for the next shredding process by the paper feeding roller while the rest of the sheets are held in the tray by providing a raised spot having a predetermined height.

However, the paper shredder has a purpose different from those of the different product lines such as printers and fax machines and, therefore, papers to be fed into the paper shredder are significantly deteriorated in quality. That is, printers and fax machines have to give the paper fed back after printing and facsimile processes, respectively. Also, the sheets of paper need to be read, checked and stored in most cases, which requires new paper or scratch paper whose quality and usability are not inferior to those of new paper to be employed. On the contrary, a paper shredder is configured to shred paper and the paper fed into the shredder may be crumpled or torn.

Thus, when papers much damaged or bent by such reasons as exposure to moisture for a long time are fed into the paper shredder in the above-described feeing manner for shredding, jamming, excessive feeding, and feeding failure could occur and the purpose of the paper feeding device could not be met.

Further, the paper feeding device according to the related art have paper feeding entrances with a certain limited height, causing paper jamming in many cases when bent or crumpled paper is fed through the entrances.

SUMMARY OF THE INVENTION

It is an object of the present invention to provide an automatic paper feeding sensing device for a paper shredder, a paper feeding device including the device, and a paper shredder including the devices, which have a simpler structure, lower malfunctioning rate and higher level of usability.

To accomplish the above object and other advantages, there is provided an automatic paper feeding sensing device including: a detection sensor fixed to an end of a sensor bracket disposed at a side of a paper feeding entrance of a paper shredder; and a rotating lever rotatably disposed between the paper feeding entrance and the detection sensor to open or close a front side of the detection sensor by the rotation thereof. The rotating lever is hinge-coupled to return to a horizontal state by a shaft fixed to a center of a body of the rotating lever, the rotating lever including a head disposed at an end of the body toward the paper feeding entrance and a tail disposed at the other end of the body toward the detection sensor, and a weight extends downward from the body between the head and the tail. The head of the rotating lever has an arc shape to protrude into the paper feeding entrance of the paper shredder, and the tail of the rotating lever is configured to block a front surface of the detection sensor and operate the sensor through an opening/closing operation due to the rotation thereof.

Also provided is a paper feeding device of a paper shredder which includes: a paper feeding section having a space for accommodating paper to be shredded, an upper portion of the paper feeding section being sealed by a cover; a paper feeding entrance having a through-hole to communicate with a cutter portion at a center of a bottom surface of the paper feeding section; paper feeding rollers disposed facing each other on both sides of the paper feeding entrance to feed the paper within the paper feeding section into the paper feeding section; and a pressurizing portion elevated by opening/closing of the cover toward the paper feeding entrance, the pressurizing portion folding the paper to be shredded in half by pressing a middle of the paper. The bottom surface of the paper feeding section has a V shape in which the bottom surface is inclined toward the lowest central portion thereof so that the paper is folded with facility.

Also provided is a paper shredder including the aforementioned paper feeding device including the automatic paper feeding sensing device abovementioned, the paper shredder comprising a cutter portion which comprises a plurality of cutter blades to shred paper and a driving motor configured to drive the cutter portion.

In the present invention, the cover includes a manual feeding entrance which extends downward into the paper feeding section oppositely to the paper feeding entrance disposed at the bottom surface of the paper feeding section, an automatic paper feeding sensing device including the rotating lever and the detection sensor of claim 1 being disposed at a side of the manual feeding entrance.

The paper shredder according to claim 25, further including a separate cutter portion including a plurality of cutter blades to shred a waste plastic panel such as a compact disc (CD), and a CD feeding entrance is disposed at a side of a manual feeding entrance disposed at a cover, the CD feeding entrance extending downward into a paper feeding section and toward the cutter portion.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE PREFERRED EMBODIMENTS

Reference will now be made in detail to a preferred embodiment of the present invention.

Figure 1:
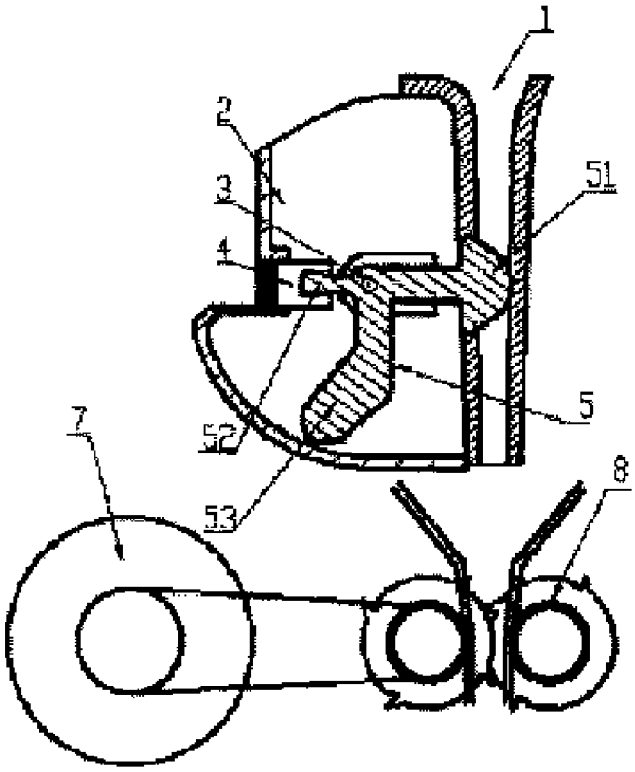
FIG. 1 is a schematic view of an automatic paper feeding sensing device for a paper shredder according to an embodiment of the present invention.
Figure 2:
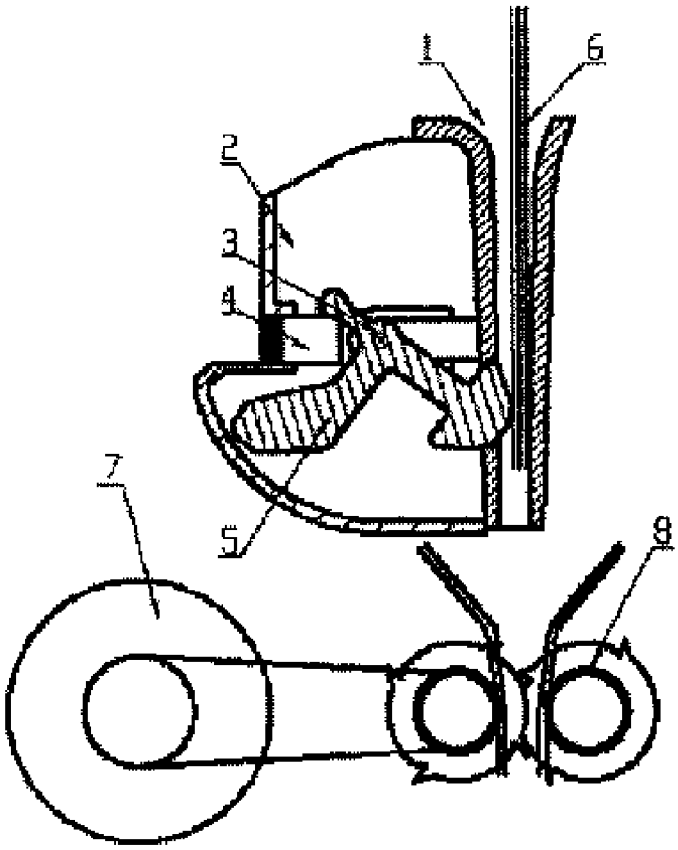
FIG. 2 is a view illustrating the automatic paper feeding sensing device of FIG. 1 in operation with paper being fed.

FIG. 1 is a schematic view of an automatic paper feeding sensing device for a paper shredder according to an embodiment of the present invention, and FIG. 2 is a view illustrating the automatic paper feeding sensing device of FIG. 1 in operation with paper being fed.

As shown in FIGS. 1 and 2, the present invention provides an automatic paper feeding sensing device including a rotating lever 5 and an optical detection sensor 4. The optical detection sensor 4 is fixed to an end of a sensor bracket 2 disposed at a side of a paper feeding entrance 1 of a paper shredder. The rotating lever 5 is rotatably coupled to the sensor bracket 2 by a shaft 3.

The rotating lever 5 is disposed between the paper feeding entrance 1 and the optical detection sensor 4. The rotating lever 5 includes a head 51 and a tail 52, and a weight 53 extends downward from a body of the rotating lever 5. The head 51 of the rotating lever 5 may protrude into the paper feeding entrance 1 in a substantially arc shape. The tail 52 is disposed at a front of the optical detection sensor 4 to operate the optical detection sensor 4 according to an opening/closing operation of the rotation lever 5.

The optical detection sensor 4 is an example of a non-contact sensor, and may be replaced with an ultrasonic sensor, an infrared sensor, or a contact sensor.

Described below is an operation of the automatic paper feeding sensing device according to the embodiment of the present invention.

As illustrated in FIG. 1, when no paper is fed into the paper feeding entrance 1, the paper shredder remains idle. In this case, the rotating lever 5 maintains bilateral symmetry on the shaft 3 because of gravity applied to the weight 53.

In addition, in this state, the head 51 of the rotating lever 5 blocks a paper passage in the paper feeding entrance, and the tail 52 of the rotating lever 5 blocks the optical detection sensor 4 so that no signal is transmitted to a driving motor 7 and a cutter portion 8.

Then, when paper is fed into the paper feeding entrance 1, as illustrated in FIG. 2, the paper to be shredded 6 pushes the head 51 of the rotating lever 5 to rotate the rotating lever 5 on the shaft 3, and the tail 52 of the rotating lever 5 deviates from a front surface of the optical detection sensor 4. Here, the optical detection sensor 4 detects paper being fed, and applies an actuation signal to the driving motor 7. Then, the driving motor 7 drives the cutter portion 8 so that the paper to be shredded 6 is shredded.

After a shredding process is over, the rotating lever 5 rotates on the shaft 3 because of the gravity applied to the weight 53 to maintain its initial parallel state. Thus, the tail 52 is returned to the front surface of the optical detection sensor 4 to maintain the signal blocking state.

The rotating lever 5 is rotated with ease even when the paper to be shredded 6 is put lightly on the head 51 because the head 51 of the rotating lever 5 has an arc shape to push the paper to be shredded 6 toward a wall if possible.

Also, the rotating lever 5 is configured to allow the optical detection sensor 4 to detect an insertion signal of the standby paper through the rotation of the tail 52. Compared with a typical paper shredder having a direct detection type, the amount of paper dust remaining on the optical detection sensor 4 may be minimized by placing the optical detection sensor 4 away from the paper to be shredded 6. As a result, a failure rate may be lowered because the demand of a degree of sensor sensitivity is not high.

Hereinafter, a structure and operation principle of a paper feeding device for paper shedder including the aforementioned automatic paper feeding sensing device will be described according to various embodiments.

First Embodiment

Figure 3:
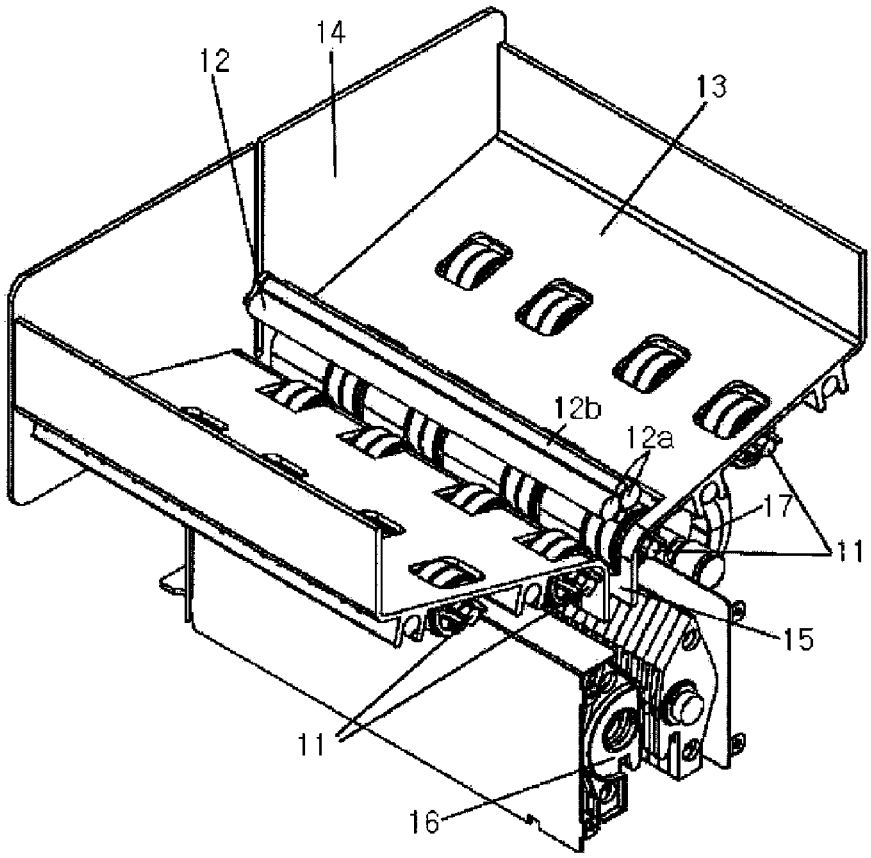
FIG. 3 is a perspective view of a paper feeding device for a paper shredder according to a first embodiment of the present invention.
Figure 4:
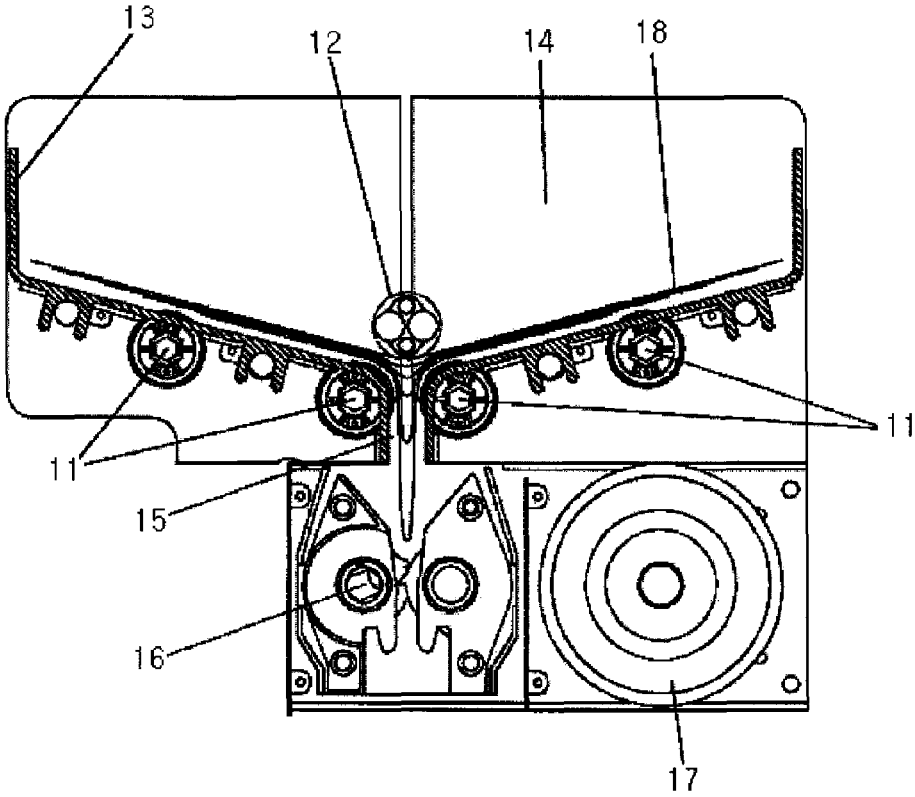
FIG. 4 is a front sectional view illustrating the paper feeding device of FIG. 3.
Figure 5:
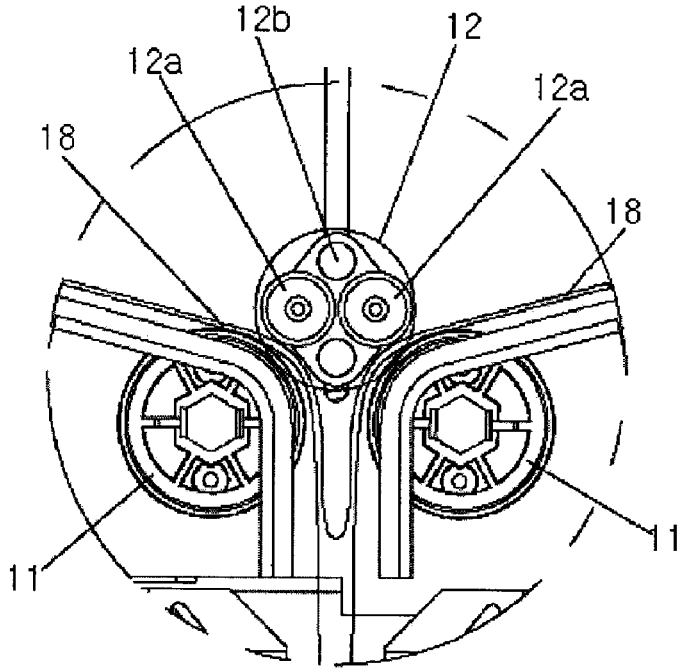
FIG. 5 is a partially enlarged sectional view illustrating the paper feeding device of FIG. 4.

FIGS. 3 to 5 are views of a paper feeding device according to a first embodiment of the present invention. FIG. 3 is a perspective view illustrating an exterior of the paper feeding device. FIG. 4 is a front sectional view illustrating the paper feeding device of FIG. 3. FIG. 5 is a partially enlarged sectional view illustrating the paper feeding device of FIG. 4.

For printers and fax machines in general, paper must be fed continuously without being crumpled or folded during and after a feeding process. However, a paper shredder does not have to meet the requirement since the purpose of a paper shredder is to shred the paper fed through the paper feeding device.

Thus, paper is allowed to be fed in a folded state into the paper feeding device according to the current embodiment of the present invention, and a paper shredder including the paper feeding device is suitable for shredding a sheet of paper crumpled, torn or bent after being exposed to moisture for an extended period of time since the sheet does not have to be fed from an end.

Referring to FIG. 3, the automatic paper feeding device of the current embodiment includes a paper feeding section 13. An upper portion of the paper feeding section 13 is sealed by a cover 21 (reference numeral 21 of FIG. 6). A cutter portion 16 and a driving motor 17 are disposed under the paper feeding section 13.

The paper feeding section 13 is a space having a predetermined size on which paper may be put to be shredded, and a bottom surface of the paper feeding section 13 has a V shape sloping gently toward a midsection of the bottom surface. A paper feeding entrance 15, which is led to the cutter portion 16, is disposed at the midsection of the paper feeding section, and paper feeding rollers 11 are disposed at both sides of the paper feeding entrance 15. In the current embodiment, the paper feeding rollers 11 may be driven toward the midsection of the paper feeding section 13, and a plurality of the paper feeding rollers 11 may be disposed in an upwardly protruding state across the bottom surface of the paper feeding section 13.

In addition, a pressurizing portion 12 is disposed at a sidewall 14 of the paper feeding section 13, and the pressurizing portion 12 is moved up and down by opening and closing the cover. When the cover is closed, the pressurizing portion 12 is directed toward the paper feeding entrance 15 disposed at the midsection of the bottom surface of the paper feeding section 13, and presses an upper midsection of the paper to be shredded with the paper being put on the paper feeding section 13.

The pressurizing portion 12 may be a combination of a plurality of bilaterally and longitudinally symmetrical rollers (or projections). Among the rollers, bilaterally symmetrical pressurizing rollers 12*a* minimize frictional force between paper 18 fed into the paper feeding entrance 15 and the pressurizing portion 12 so that the paper 18 can be fed smoothly. Longitudinally symmetrical direction-guiding rollers 12*b* (or direction-guiding projections) support the two pressurizing rollers 12*a* between the two pressurizing rollers 12*a* while the lower direction-guiding roller 12*b* pressing a midsection of the paper 18 so that the paper 18 can be fed smoothly.

In the current embodiment of the present invention, a diameter of the direction-guiding roller 12*b* may be the same to or smaller than an aperture of the paper feeding entrance 15, and a diameter of the pressurizing roller 12*a* may be the same as or larger than the aperture of the paper feeding entrance 15.

Although the drawings of the paper feeding device according to the current embodiment of the present invention do not illustrate the aforementioned paper feeding sensing device of FIG. 1, the embodiment described hereinafter with FIGS. 6 and 7 as well as the current embodiment is assumed to be equipped with the aforementioned paper feeding sensing device of FIG. 1.

Second Embodiment

Described hereinafter is another embodiment of a paper feeding device according to a second embodiment of the present invention.

Figure 6:
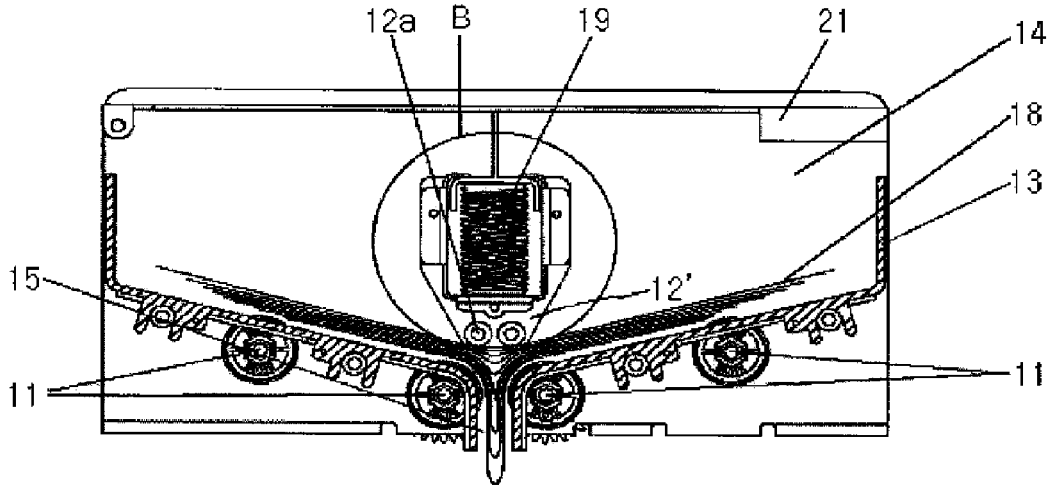
FIG. 6 is a front sectional view of a paper feeding device for a paper shredder according to a second embodiment of the present invention.
Figure 7:
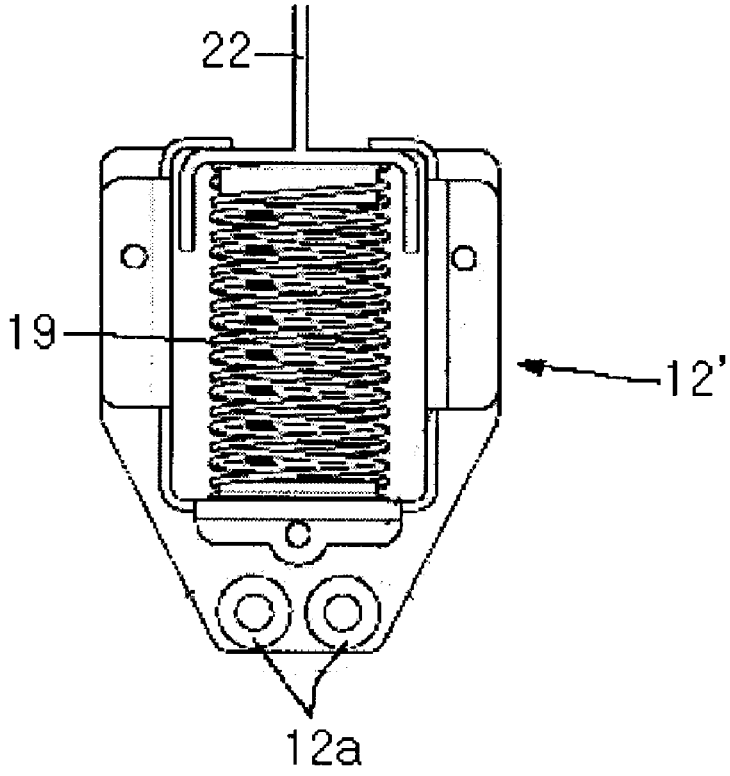
FIG. 7 is a partially enlarged sectional view illustrating the paper feeding device of FIG. 6.

FIGS. 6 and 7 illustrate another embodiment of a paper feeding device according to the second embodiment of the present invention. FIG. 6 is a front sectional view of a paper feeding device for a paper shredder according to a second embodiment of the present invention, and FIG. 7 is a partially enlarged sectional view illustrating the paper feeding device of FIG. 6.

As illustrated, the paper feeding device according to the current embodiment includes a paper feeding section 13. An upper portion of the paper feeding section 13 is sealed by a cover 21. A bottom surface of the paper feeding section 13 has a vee shape sloping gently toward a midsection of the bottom surface. A paper feeding entrance 15, which is led to a cutter portion 16, is disposed at the midsection of the paper feeding section, and paper feeding rollers 11 are disposed at both sides of the paper feeding entrance 15. In the current embodiment, the paper feeding rollers 11 may be driven toward the midsection of the paper feeding section 13, and a plurality of the paper feeding rollers 11 are disposed in an upwardly protruding state across the bottom surface of the paper feeding section 13.

In addition, a pressurizing portion 12' is disposed at a sidewall 14 of the paper feeding section 13, and the pressurizing portion 12' is moved up and down by opening and closing the cover 21. When the cover 21 is closed, the pressurizing portion 12' is directed toward the paper feeding entrance 15 disposed at the midsection of the bottom surface of the paper feeding section 13, and presses an upper midsection of the paper to be shredded with the paper being put on the paper feeding section 13.

The pressurizing portion 12' is a combination of at least bilaterally symmetrical pressurizing rollers 12*a*, and upper portions of the pressurizing rollers 12*a* may be moved up and down biased by a spring 19 against a supporting plate 22 extending downward from the cover 21.

In the current embodiment, the pressurizing roller 12*a* may come into contact with the paper feeding roller 11 with the cover 21 closed, and a diameter of the pressurizing roller 12*a* may be the same as or larger than an aperture of the paper feeding entrance.

Third Embodiment

Described hereinafter are a paper feeding device and a paper shredder including the paper feeding device, according to a third embodiment of the present invention.

Figure 8:
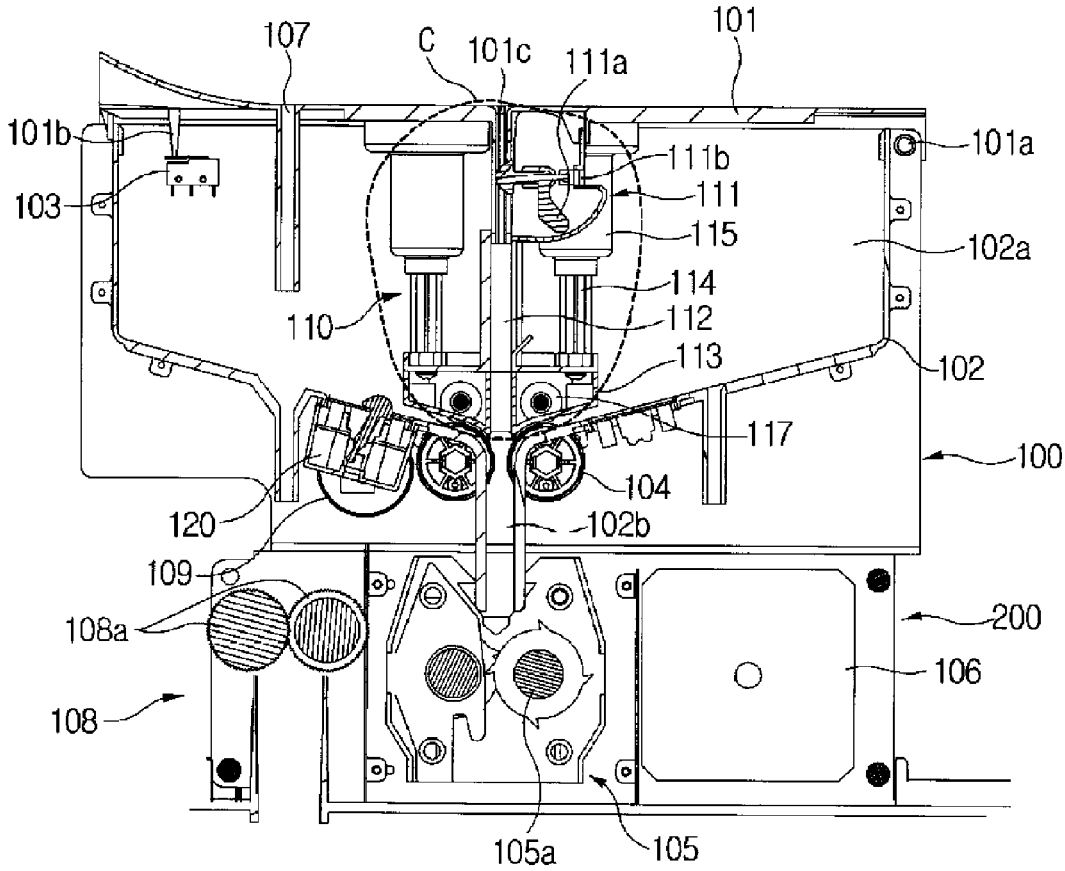
FIG. 8 is a front sectional view of a paper feeding device for a paper shredder according to a third embodiment of the present invention.
Figure 9:
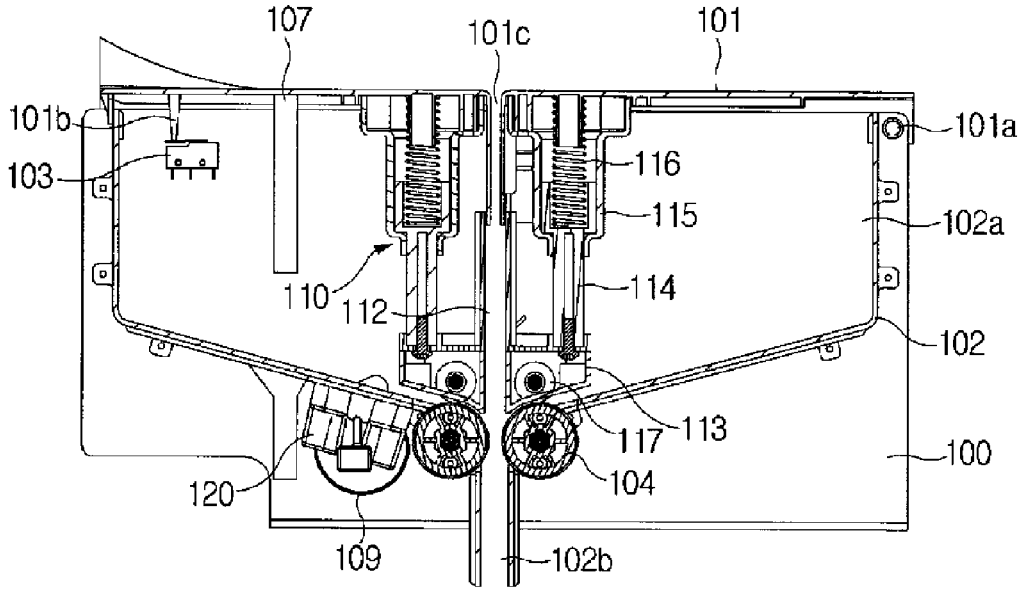
FIG. 9 is a partially enlarged sectional view illustrating the paper feeding device of FIG. 8.
Figure 10:
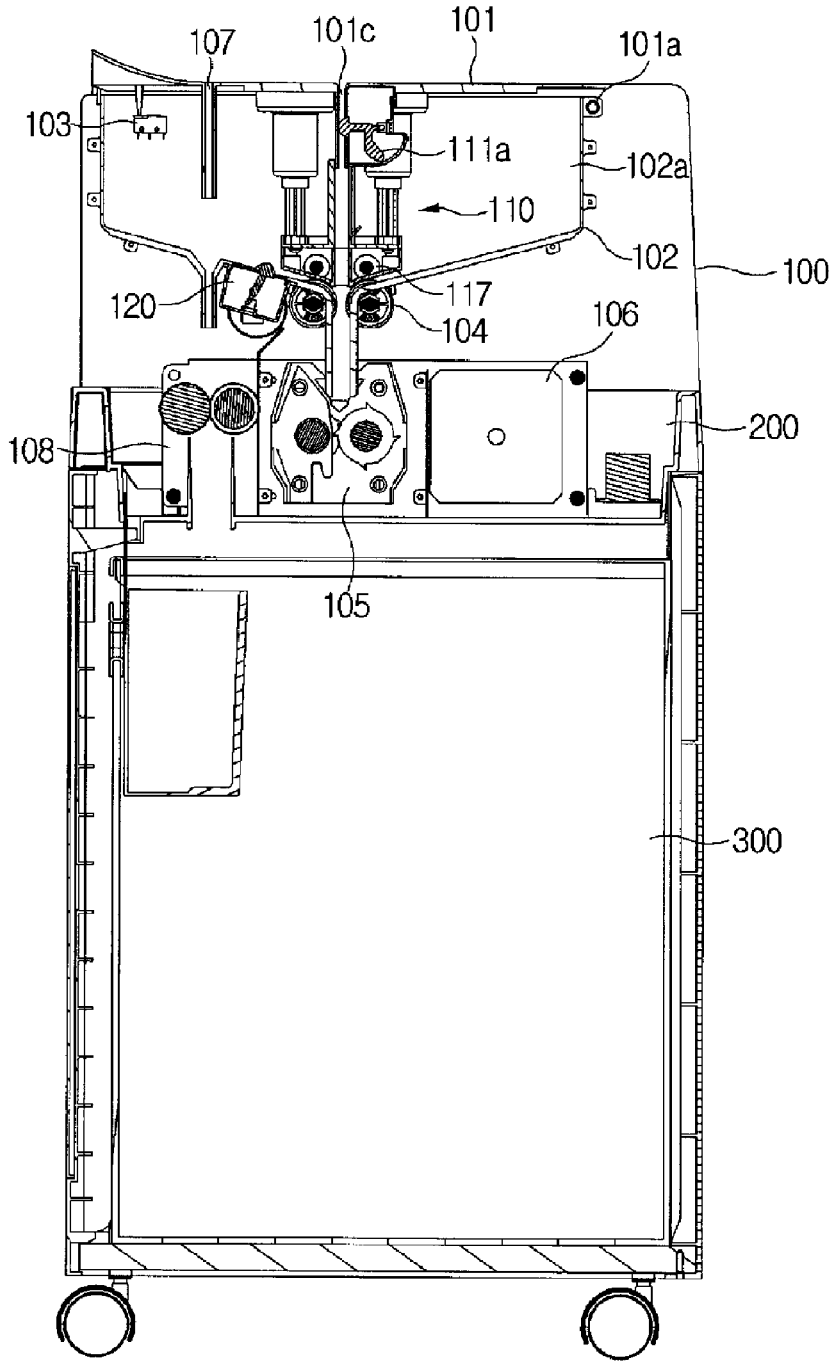
FIG. 10 is a schematic sectional view illustrating an example of an automatic paper shredder including the paper feeding device of FIG. 8.

FIG. 8 is a front sectional view illustrating an automatic paper feeding device according to the current embodiment, FIG. 9 is an enlarged view illustrating a portion of FIG. 8, and FIG. 10 is a front sectional view illustrating a paper shredder including the automatic paper feeding device of FIG. 8.

Referring to FIGS. 8, 9 and 10, the automatic paper feeding device includes a paper feeding section 100, an upper portion of which is sealed by a cover 101, and a pressurizing portion 110 which is moved up and down into and out of the paper feeding section 100 by opening and closing the cover 101. A shredding portion 200 is disposed in a lower portion of the paper feeding section 100, and includes cutter portions 105 and 108 including a plurality of cutter blades 105*a* and 108*a*, and a driving motor 106 configured to drive the cutter portions 105 and 108.

The paper feeding section 100 includes a paper feeding tray 102 which has a space 102*a* having a predetermined size to accommodate paper to be shredded. A bottom surface of the paper feeding tray 102 has a vee shape sloping gently toward a midsection of the bottom surface.

A paper feeding entrance 102*b* connected to the lower cutter portion 105 is disposed at a midsection of the paper feeding tray 102, and paper feeding rollers 104 driven by the driving motor 106 are disposed at both upper ends of the paper feeding entrance 102*b*. In the current embodiment, the paper feeding rollers 104 may be driven toward the midsection of the paper feeding tray 102, and a plurality of the paper feeding rollers 104 may be disposed in an upwardly protruding state across the bottom surface of the paper feeding section 100. Here, the paper feeding rollers 104 may be disposed in bilateral symmetry on the paper feeding entrance 102*b* to prevent paper to be shredded from being pushed in a certain lateral direction.

The paper feeding tray 102 may have a vee shape with the midsection being lower than both sides so that a midsection of the paper to be shredded can be folded. However, the present invention is not limited thereto, and the paper feeding tray 102 may have a flat and slope-less shape.

A portion of the paper feeding roller 104 coming into contact with paper may be formed of a frictional material such as rubber, and a frictional projection (not illustrated) may be formed on a circumferential surface of the paper feeding roller 104 so that many sheets of paper can be moved at a time by friction. The frictional projection may come in various forms, examples of which include a metal probe, rubber embossing, and bump.

In the automatic paper feeding device of the current embodiment, the cover 101 can be vertically opened and closed on a hinge portion 101*a*, and a sensing unit may be disposed at a side of the cover 101 to detect the opening and closing of the cover 101. A microswitch 103 may be disposed at the side of the cover 101 to form the sensing unit, and a pressing piece 101*b* having a predetermined shape may be disposed at a surface of the cover 101 so that the microswitch can be pressed with the pressing piece 101*b*.

In addition, the cover 101 may include a locking hook 101*d*, and the locking hook 101*d* may maintain a locking state automatically while the cover 101 is closed so that the cover 101 cannot be opened during a shredding process.

Further, the cover 101 may include a manual feeding entrance 101*c* facing the paper feeding entrance 102*b* disposed at the midsection of the paper feeding tray 102. A single sheet or small amount of paper can be fed directly into the manual feeding entrance 101*c*. The manual feeding entrance 101*c* may extend downward into the paper feeding tray 102, and the paper may be fed into the lower cutter portion 105 through the paper feeding entrance 102*b*.

A paper feeding sensing device 111, which includes a rotating lever 111*a* and an optical detection sensor 111*b* as illustrated in FIG. 1, may be disposed at a side of the manual feeding entrance 101*c*. The rotating lever 111*a* includes a head, a tail and a weight extending downward to a lower portion of a body of the rotating lever 111*a*. The head protrudes into the manual feeding entrance 101*c* in an arc shape, and the tail is disposed at a front of the optical detection sensor 111*b* to operate the optical detection sensor 111*b* by rotation-based opening and closing. The optical detection sensor 111*b* may be replaced with an ultrasonic sensor, an infrared sensor, or a contact sensor.

The paper shredder (refer to FIG. 10) including the automatic paper feeding device of the current embodiment may include an additional feature to shred a waste plastic panel such as a compact disc (CD). To that end, the cutter portion 108 including a plurality of the cutter blades 108*a* (refer to FIG. 8) may be disposed in the shredding portion 200, and a CD feeding entrance 107 may be disposed at a side of the manual feeding entrance 101*c* disposed at the cover 101 of the paper feeding section 100. The CD feeding entrance 107 may extend downward into the paper feeding tray 102, and a CD may be fed into the lower cutter portion 108 after passing through the bottom surface of the paper feeding tray 102.

Although not illustrated, the CD feeding entrance 107 may be added with a CD feeding sensing device including a rotating lever and an optical detection sensor as in the case of the manual feeding entrance 101*c*.

In the automatic paper feeding device of the current embodiment, the pressurizing portion 110, which is moved up and down into and out of the paper feeding tray 102 by opening and closing the cover 101, is coupled with a lower portion of the cover 101 and is directed toward the paper feeding entrance 102*b* disposed in the midsection of the bottom surface of the paper feeding tray 102 when the cover 101 is closed. When paper to be shredded is put on the paper feeding tray 102, the pressurizing portion 110 folds the paper by pressing a midsection of an upper surface of the paper.

The pressurizing portion 110 includes pressurizing presses 114 at both sides of the manual feeding entrance 101*c*. The pressurizing presses 114 may be extended or compressed according to a thickness of the paper put in the inner space 102*a* of the paper feeding tray 102. Here, the pressurizing press 114 may be a hydraulic press, an air press, or an elastic press based on spring force. As an example, the pressurizing press 114 using spring elasticity is described in the current embodiment. In this case, an upper portion of the pressurizing press 114 includes a cylinder portion 115 including a built-in spring 116.

In addition, a through hole 112 may be disposed between the pressurizing presses 114 to connect the manual feeding entrance 101*c* with the paper feeding entrance 102*b*, and a pressurizing head 113 is disposed in direct contact with paper to be shredded at a lower portion of the pressurizing press 114. In the current embodiment, a plurality of the pressurizing presses 114 may be disposed in a row at each of both sides of the manual feeding entrance 101*c*. In this case, the lower portion of each of the pressurizing presses 114 may be linked to the pressurizing head 113.

The pressurizing head 113 may include a plurality of pressurizing rollers 117 corresponding to the paper feeding rollers 104 disposed at both sides of the paper feeding entrance 102*b*. The bilaterally symmetrical pressurizing rollers 117 minimize frictional force between the paper fed into the paper feeding entrance 102*b* and the pressurizing head 113 so that the paper can be fed smoothly. A midsection of a lower portion of the pressurizing head 113 may protrude downward to press the midsection of paper to be fed, so that the paper can be fed in a folded state through the paper feeding entrance 102*b* and a larger amount of paper can be supplied to the shredding portion 200 in a shorter period of time than when paper is fed through the manual feeding entrance 101*c*.

In the current embodiment, one portion of the pressurizing rollers 117 may protrude downward from the pressurizing head 113 to feed the paper to be shredded smoothly and minimize friction loss which may be generated between the pressurizing head 113 and the paper feeding roller 104 when there is no paper in the inner space 102*a*, a spring disposed at the pressurizing press 114 is put in a free-field state, and the pressurizing roller 117 and the paper feeding roller 104 come into contact with each other.

In the current embodiment, the paper feeding tray 102 may include a detecting unit 120 disposed at a side of the bottom surface of the paper feeding tray 102 to detect whether any paper to be shredded is placed in the paper feeding tray 102. The detecting member 120 may include an optical detection sensor or an infrared or UV sensor, like the paper feeding sensing device 111 provided to the manual feeding entrance 101*c*. Furthermore, the detecting member 120 may use a mechanical detection method using a microswitch, or a mechanical-optical detection method combining the mechanical detection method and an optical detection method using an optical detection sensor or an infrared or UV sensor.

Described hereinafter with reference to the above-mentioned are an automatic paper feeding sensing device and a paper shredder including the sensing device.

Figure 11:
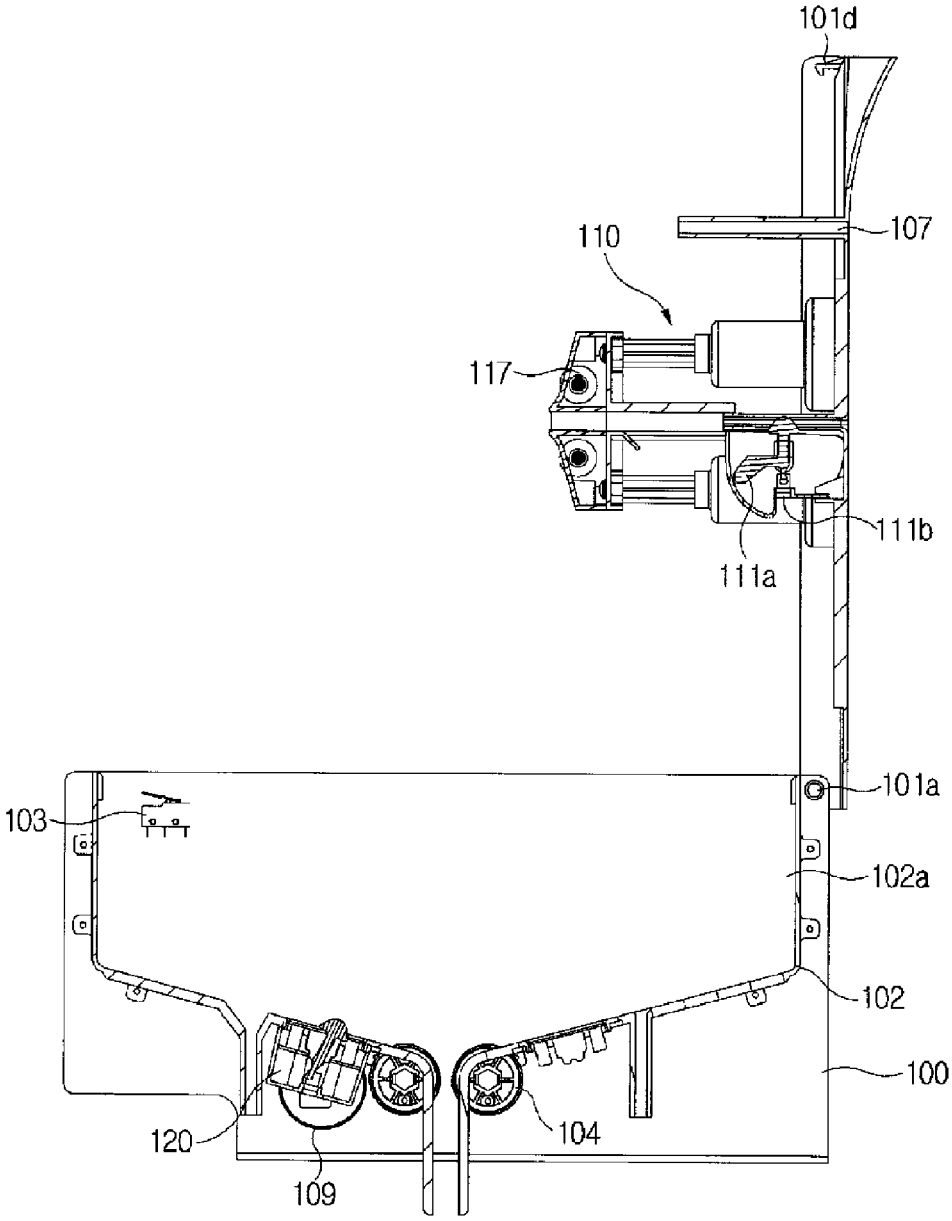
FIG. 11 is a view illustrating the paper feeding device of FIG. 8 with an upper cover opened for paper to be fed.
Figure 12:
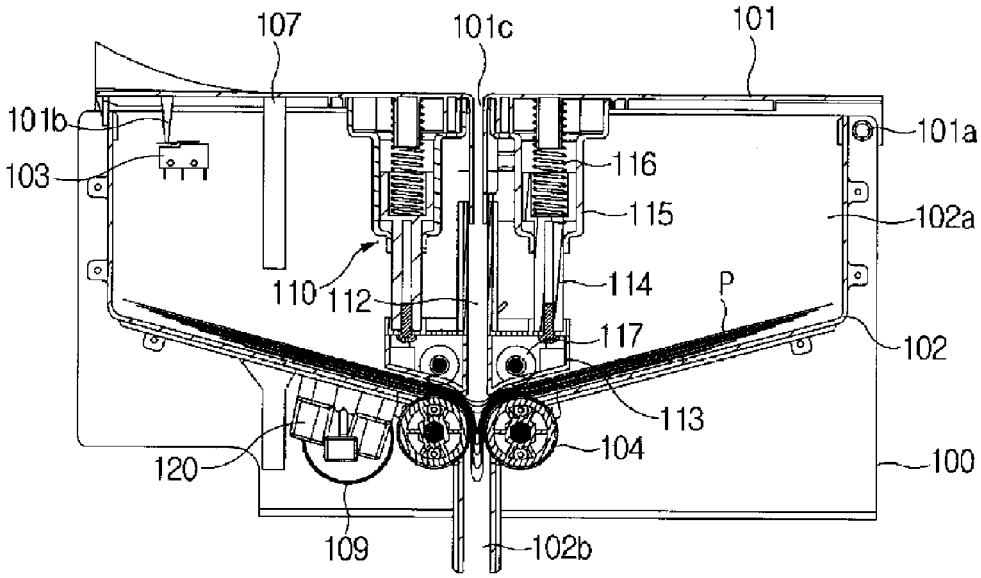
FIG. 12 is a view illustrating the paper feeding device of FIG. 8 in operation with the upper cover closed after paper is fed.

FIGS. 11 and 12 are views illustrating a paper feeding device of the present invention in use and operation. FIG. 11 is a view illustrating the paper feeding device of FIG. 8 with an upper cover opened for paper to be fed, and FIG. 12 is a view illustrating the paper feeding device of FIG. 11 in operation with the upper cover closed after paper is fed.

The operation of the paper feeding device starts when the upper cover 101, which is closed while the paper feeding device is in an idle mode, is opened and paper to be shredded is fed into the paper feeding tray 102. Then, the detecting unit disposed at the bottom surface of the paper senses that the paper is fed, and the sensing process is carried out by the paper pressing a head of an actuation lever and lead a tail of the actuation lever to deviate from the front of the optical detection sensor. Here, the optical detection sensor disposed at the detecting unit 120 senses that the paper is fed, and applies an actuation signal to the driving motor 106. With the upper cover closed and a safety lock released, the driving motor 106 drives the cutter portion 105 to shred the paper.

In the meantime, the driving motor 106 halts the operation for user safety when the upper cover is opened. When the cover 101 is closed, the pressurizing projection 101*b* disposed at a side of the cover presses the microswitch 103 to release the safety lock and let the driving motor 106 drive. Here, in the pressurizing portion 110 of the paper feeding device, the pressurizing head 113 is pressed upward correspondingly to the thickness of the paper put in the paper feeding tray on the upper cover 101 being closed, which compresses the spring 116 in the cylinder portion 115. Then, elastic rebound force corresponding to the spring compression is applied to the pressurizing press 114, which lets the paper to be shredded come into contact with the paper feeding roller 104.

The paper feeding roller 104 feeds the paper, sheet by sheet or sheets by sheets from the sheet of the paper placed at a lowermost position of the paper feeding tray 102, into the cutter portion 105 through the paper feeding entrance 102*b*. Here, the paper is folded in half by the paper feeding rollers 104 operating in opposite directions. In the abovementioned manner, when every sheet of the paper is moved to the cutter portion 105 through the paper feeding entrance 102*b*, the pressurizing roller 117 and the paper feeding roller 104 rotate in contact with each other, and the friction loss between the paper feeding roller 104 and the pressurizing head 113 is prevented. In addition, when shredding of the paper placed in the paper feeding tray 102 is completed, the detecting unit disposed at the bottom surface senses that there is no more paper inside, and halts the operation of the driving motor 106 and the paper shredder.

Meanwhile, paper can be fed through the manual feeding entrance 101*c* disposed at the midsection of the cover 101 without having to open the upper cover 101 of the paper feeding device when only one or two sheets of paper need to be shredded or the amount of the paper to be shredded is less than the maximum shredding capacity of the cutter portion 105. When paper is fed through the manual feeding entrance 101*c*, the paper feeding sensing device disposed at disposed at the side of the manual feeding entrance 101*c* detects the paper. Then, the paper pushes a head of the rotating lever to rotate the rotating lever, and a tail of the rotating lever deviates from the front of the optical detection sensor releasing the safety lock. The sensor, sensing the paper, applies a signal to drive the driving motor 106. The paper is moved to the cutter portion 105 through the manual feeding entrance 101*c*, the through hole 112*c*, and the paper feeding entrance 102*b*. When the shredding process is over, the driving motor 106 halts.

As described above, compared with a paper shredder of direct detection type, the automatic paper feeding sensing device of the present invention can minimize the amount of paper dust remaining on the detection sensor since the sensor is disposed relatively far away from the paper to be shredded and the sensor is not exposed to external environments. In addition, a failure rate of the paper shredder including the device can be lowered by means of the aforementioned structure since the structure does not require an especially high level of sensor sensitivity.

Further, in the case of the paper shredder including the device, paper is allowed to be fed in a folded state into the shredding portion. The paper shredder including the device is suitable especially for shredding a sheet of paper crumpled, torn or bent after being exposed to moisture for an extended period of time, and can address the drawback of ordinary paper shredders such as jamming, feeding failure, and excessive feeding. Moreover, the paper shredder can reduce the time required for shredding, increase the lifespan of the components inside, and save power consumption since the paper is fed after the paper is folded in half.

Also, by including the manual feeding entrance disposed at the cover for a small amount of paper to be fed through the entrance, the paper shredder of the present invention can shred the paper in certain cases without the upper cover having to be opened, which increases user convenience.

The foregoing embodiment is merely exemplary and is not to be construed as limiting the present invention. The present teachings can be readily applied to other types of apparatuses. The present invention can also apply to the second row seat. The description of the present invention is intended to be illustrative, and not to limit the scope of the claims. Many alternatives, modifications, and variations will be apparent to those skilled in the art.

What is claimed is:

1. A paper feeding device of a paper shredder, comprising:

a paper feeding section having a space for accommodating paper to be shredded, an upper portion of the paper feeding section being sealed by a cover;

a paper feeding entrance having a through-hole to communicate with a cutter portion at a center of a bottom surface of the paper feeding section;

paper feeding rollers disposed facing each other on both sides of the paper feeding entrance to feed the paper within the paper feeding section into the paper feeding section; and a pressurizing portion elevated by opening/closing of the cover toward the paper feeding entrance, the pressurizing portion folding the paper to be shredded in half by pressing a middle of the paper, wherein the bottom surface of the paper feeding section has a V shape in which the bottom surface is inclined toward the lowest central portion thereof so that the paper is folded with facility.

2. The paper feeding device of the paper shredder according to claim 1, wherein the paper feeding roller is disposed to protrude upward across the bottom surface of the paper feeding section, thereby being driven toward a center of the paper feeding section.

3. The paper feeding device of the paper shredder according to claim 1, wherein the pressurizing portion comprises pressurizing rollers which are combined with each other in a bilaterally symmetrical manner, the pressurizing rollers minimizing a frictional force between the pressurizing portion and the paper fed through the paper feeding entrance so that the paper is fed smoothly through the paper feeding entrance.

4. The paper feeding device of the paper shredder according to claim 3, wherein the pressurizing portion further comprises direction-guiding units which are combined with each other in a longitudinally symmetrical manner to provide a support between the two pressurizing rollers, at least the lower direction-guiding units having a roller shape or a projecting shape to press the middle of the paper and feed the paper smoothly.

5. The paper feeding device of the paper shredder according to claim 4, wherein the pressurizing portion is provided so that each of the direction-guiding units has a diameter equal to or less than an aperture of the paper feeding entrance, and the pressurizing roller has a diameter equal to or greater than the aperture of the paper feeding entrance.

6. The paper feeding device of the paper shredder according to claim 3, wherein an upper portion of the pressurizing roller is elastically supported by a spring and maintained in an elevatable manner oppositely to a supporting plate extending downward from the cover.

7. The paper feeding device of the paper shredder according to claim 3, wherein the pressurizing roller is disposed to contact the paper feeding roller when the cover is closed.

8. The paper feeding device of the paper shredder according to claim 1, wherein a portion of the paper feeding roller which comes into contact with the paper is formed of a frictional material such as rubber, and a plurality of frictional projections or metal needles are disposed on a circumference surface of the paper feeding roller so that a large amount of paper is fed at once by means of frictional force.

9. The paper feeding device of the paper shredder according to claim 1, wherein the cover comprises a manual feeding entrance which extends downward into the paper feeding section oppositely to the paper feeding entrance disposed at the bottom surface of the paper feeding section, an automatic paper feeding sensing device comprising the rotating lever and the detection sensor of claim 1 being disposed at a side of the manual feeding entrance.

10. The paper feeding device of the paper shredder according to claim 9, wherein the rotating lever comprises a head, a tail, and a weight extending toward a lower portion of a body of the rotating lever, the head, having an arc shape, protruding into the manual feeding entrance, and the tail being disposed at a front portion of the detection sensor to operate the sensor by an opening and closing operation due to the rotation.

11. The paper feeding device of the paper shredder according to claim 9, wherein the detection sensor is replaceable with a contact sensor or a non-contact sensor such as an ultrasonic sensor or an infrared sensor.

12. The paper feeding device of the paper shredder according to claim 9, wherein the pressurizing portion comprises a pressurizing press disposed at each of both sides of the manual feeding entrance, the pressurizing press being a hydraulic press, an air press, or an elastic press based on spring force so that expansion or contraction takes place depending on a thickness of the paper disposed in the paper feeding section.

13. The paper feeding device of the paper shredder according to claim 12, wherein an upper portion of the pressurizing press comprises a built-in spring cylinder, an air cylinder, or a hydraulic cylinder, a through-hole is formed between the pressurizing presses bilaterally or longitudinally symmetrical to each other to connect the manual feeding entrance with the paper feeding entrance, and a pressurizing head is disposed at a lower portion of the pressurizing press to directly contact an upper portion of the paper to be shredded.

14. The paper feeding device of the paper shredder according to claim 13, wherein a plurality of the pressurizing presses are disposed in a row on both sides of the manual feeding entrance, and the lower portions of the pressurizing presses are interconnected by the pressurizing head.

15. The paper feeding device of the paper shredder according to claim 13, wherein the pressurizing head comprises a plurality of pressurizing rollers disposed oppositely to the paper feeding rollers disposed at the both sides of the paper feeding entrance, and the pressurizing rollers, which are bilaterally symmetrical to each other, minimize friction force between the paper feeding roller and the paper fed through the paper feeding entrance so that the paper is fed smoothly through the paper feeding entrance.

16. The paper feeding device of the paper shredder according to claim 13, wherein a center of a lower portion of the pressurizing head protrudes downward to press the middle of the paper so that the paper is fed through the paper feeding entrance in a folded state.

17. The paper feeding device of the paper shredder according to claim 13, wherein a part of the pressurizing roller protrudes downward from the pressurizing head so that the pressurizing roller comes into contact with the paper feeding roller with the spring being in a free-field state and reduces friction loss generated between the pressurizing head and the paper feeding roller.

18. The paper feeding device of the paper shredder according to claim 1, wherein the cover, which is vertically opened and closed on a hinge, comprises a detecting unit disposed at a side of the cover to detect whether the cover is opened or closed, the detecting unit comprising a microswitch disposed at a side of the cover and a pressing piece disposed at a surface of the cover to apply pressure to the micro switch.

19. The paper feeding device of the paper shredder according to claim 1, wherein the cover comprises a locking unit configured to keep the cover closed while shredding is underway.

20. The paper feeding device of the paper shredder according to claim 1, wherein the paper feeding section comprises a sensing unit disposed at a side of the bottom surface to detect a presence of paper to be fed, the sensing unit being an automatic paper feeding sensing device comprising the rotating lever and the detection sensor of claim 1.

21. A paper shredder comprising the paper feeding device of claim 1 with the automatic paper feeding sensing device of claim 1, the paper shredder comprising a cutter portion which comprises a plurality of cutter blades to shred paper and a driving motor configured to drive the cutter portion.

22. The paper shredder according to claim 21, further comprising a separate cutter portion comprising a plurality of cutter blades to shred a waste plastic panel such as a compact disc (CD), and a CD feeding entrance is disposed at a side of a manual feeding entrance disposed at a cover, the CD feeding entrance extending downward into a paper feeding section and toward the cutter portion.

* * * * *